United States Patent [19]

Yoshida et al.

[11] Patent Number: 4,651,389

[45] Date of Patent: Mar. 24, 1987

[54] SLIDE FASTENER

[75] Inventors: Hiroshi Yoshida; Yoshitoki Tsubokawa, both of Toyama, Japan

[73] Assignee: Yoshida Kogyo K. K., Tokyo, Japan

[21] Appl. No.: 783,656

[22] Filed: Oct. 3, 1985

[30] Foreign Application Priority Data

Oct. 25, 1984 [JP] Japan ..... 59-161249[U]

[51] Int. Cl.[4] ..... A44B 19/36

[52] U.S. Cl. ..... 24/433; 24/398; 24/434

[58] Field of Search ..... 24/433, 434, 435, 447, 24/652, 693, 384, 389, 394, 397, 398, 90 HA

[56] References Cited

U.S. PATENT DOCUMENTS

| | | | |
|---|---|---|---|
| Re. 18,571 | 8/1932 | Avedon | 24/433 |
| 2,020,007 | 11/1935 | Wagman | 24/90 HA |
| 3,030,684 | 4/1962 | Johns et al. | 24/434 |
| 3,377,668 | 4/1968 | Carlile et al. | 24/434 |
| 3,490,970 | 1/1970 | Heimberger | 24/435 |
| 3,540,084 | 11/1970 | Frohlich | 24/398 |
| 4,001,922 | 1/1977 | Ward, Jr. | 24/434 |
| 4,138,771 | 2/1979 | Manning | 24/434 |
| 4,182,006 | 1/1980 | Yoshida | 24/397 |
| 4,221,026 | 9/1980 | Kanzaka | 24/433 |

*Primary Examiner*—Victor N. Sakran

*Attorney, Agent, or Firm*—Hill, Van Santen, Steadman & Simpson

[57] ABSTRACT

A slide fastener has tape-reinforcing portions used for mounting a separable end stop. Each of the tape-reinforcing portions is provided at one end portion of each of a pair of fastener tapes, and includes a reinforcing piece which has one side surface adapted to be bonded to the corresponding fastener tape, and a surface layer made of a thermoplastic resin material which is provided on the other side surface of the reinforcing layer. The thermoplastic resin material which forms the surface layer is selected from those thermoplastic resin materials which have a low enough melting point to make it possible for the tape-reinforcing portion to be welded to the portion of an article to which the slide fastener is attached.

2 Claims, 9 Drawing Figures

SLIDE FASTENER

BACKGROUND OF THE INVENTION

1. Field of the Invention

The present invention relates to a slide fastener with a separable end stop, which is attached by ultrasonic or high-frequency welding to the opening of an article such as a raincoat, anorak, or bag made of a sheet of thermoplastic resin material.

2. Description of the Prior Art

In a conventional slide fastener which has a separable end stop, it is well known to facilitate stable attachment of the separable end stop to a slide fastener, easy operation of the separable end stop upon engagement or disengagement thereof, and reinforcement of attachment condition between lower end of a slide fastener and a separable end stop by providing a separable end stop attachment portion located at one end of the fastener tape with a reinforcing member.

In a case of a slide fastener which has a separable end stop and which is formed from a sheet of thermoplastic synthetic resin material such as polyvinyl chloride, a reinforcing member is also attached to a separable end stop attachment portion. When attaching such slide fastener to, for example, a raincoat made from a sheet of synthetic resin material, thermal bonding means is utilized.

The reinforcing member has a multi-layer structure consisting of a bonding layer having a low enough melting point to enable it to be bonded to the fastener tape, and a reinforcing layer having a melting point which is higher than that of the bonding layer. Since the reinforcing layer is generally formed of a film which has a relatively high melting point, such as Nylon 6 or Nylon 66, or a taffeta using threads of such a material, the portion of the fastener tape excluding the reinforcing member can be integrally welded to an attachment portion of the article by an ultrasonic or high-frequency welder, but the conventional slide fastener has a disadvantage in that it is impossible to completely weld to the article the portion of the fastener tape on which the reinforcing member is mounted.

In other words, in a conventional slide fastener, the reinforcing member of the separable end stop attachment portion, which should be most firmly attached to the article, is not welded to the article. Furthermore, since the article is generally formed of a slippery unwoven material made of a thermoplastic resin, the non-welding of the reinforcing member to the article occasionally causes relative slippage between the article and the member. Consequently, when the reinforcing member and the article are held together between the fingers to manipulate the separable end stop, this slippage means that the movements of the fingers cannot be conveyed to the separable end stop as intended, resulting in the incomplete insertion of the butterfly pin or the forcible pulling-up of the slider.

Thus, the slide fastener with the separable end stop provided by the prior art has problems in that, due to the incomplete bonding between the reinforcing member and the article, the separable end stop cannot be smoothly manipulated. Furthermore, if the fastener elements are engaged imperfectly by applying excessive force, these elements will be disengaged afterward.

SUMMARY OF THE INVENTION

Accordingly an object of the present invention is to provide a slide fastener which has a reinforcing portion for mounting a separable end stop, which portion is capable of being welded, not only to a fastener tape, but also to the article to which the slide fastener is attached.

In accordance with the present invention, a slide fastener comprises a pair of fastener tapes made of a flexible thermoplastic resin material, a tape-reinforcing portion provided on an end portion of each of this pair of fastener tapes, and a separable end stop provided on both the tape-reinforcing portions.

Each tape-reinforcing portion in turn includes a reinforcing piece of which one side is adapted to be bonded to the corresponding fastener tape, and a surface layer provided on the other side of the reinforcing piece, the surface layer being made of a thermoplastic resin of a low enough melting point to enable the reinforcing portion to be welded to the article to which the slide fastener is attached. By virtue of this arrangement of the tape-reinforcing portion, the present invention makes it possible for the tape-reinforcing portion to be bonded not only to the fastener tape, but also to a portion of the article to which it is attached, by the surface layer made of thermoplastic resin.

According to one embodiment of the present invention, the outer surface of the surface layer is designed to have irregularities which enable the accurate manipulation of the separable end stop through the article.

DESCRIPTION OF THE PREFERRED EMBODIMENTS

Figure 1:
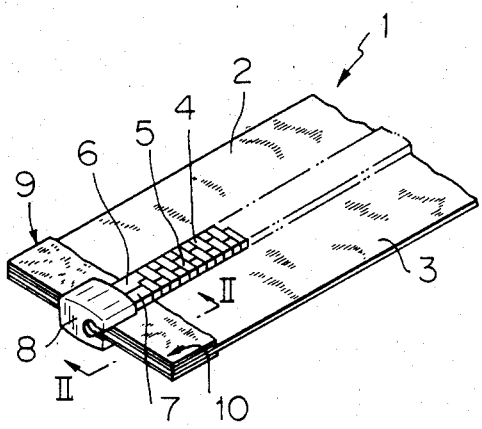
FIG. 1 is a perspective view of the slide fastener with the separable end stop according to the present invention, showing one end portion of the slide fastener.

Referring first to FIG. 1, which shows a part of a slide fastener 1 with a separable end stop according to the present invention, a pair of fastener tapes 2, 3 constituting the slide fastener are formed from, for example, a sheet of a thermoplastic synthetic resin such as a polyvinyl chloride, a polyester, or polyamide, or from a non-woven material including thermoplastic synthetic resin fibers. Both fastener tapes 2, 3 have side edges which face each other and on which fastener elements 4, 5 of a type selected from various forms are respectively mounted. The tape 2 has a lower end portion on which a butterfly pin 6 constituting part of the separable end stop is secured, while a box pin 7 and a box body, also constituting part of the separable end stop, are secured to the lower end portion of the other tape 3. As shown in FIG. 1, the butterfly pin 6 and the box pin 7 are mounted on the corresponding fastener tapes over tape reinforcing portions 9, 10, respectively, which are provided for mounting the separable end stop, the reinforcing portions being provided at the lower end portions of both of the fastener tapes.

Figure 2:
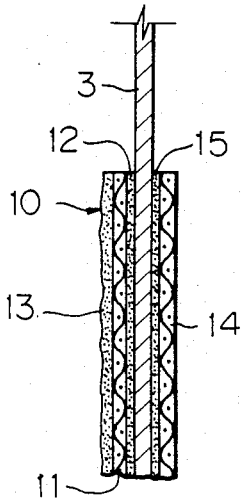
FIG. 2 is a section taken along line II—II of FIG. 1.

As shown in FIG. 2, each tape-reinforcing portion has a reinforcing piece 11 which is formed either of a film of synthetic resin having a high melting point, such as Nylon 66 or Nylon 6, or of a taffeta made from synthetic fiber threads which also have a high melting point. The tape-reinforcing portion also has a bonding layer 12 which is formed on one side surface of the reinforcing piece 11, that is, on the surface thereof facing the fastener tape, and which is made of a synthetic resin film having a low melting point, such as copolymer polyamide film or copolymer polyester film, by which the reinforcing piece 11 can be integrally welded to either the front or rear surface of the fastener tape 3, or both the front and rear surfaces thereof. The tape-reinforcing portion further includes a surface layer 13 integrally bonded to the other side surface of the reinforcing piece 11, i.e., on the surface thereof which does not face the fastener tape. The surface layer 13 is formed either of a film of a synthetic resin having a low enough melting point to enable the tape reinforcing portion to be welded to a portion of the article to which the slide fastener is to be attached, such as a copolymer polyamide or copolymer polyester, or of a layer formed by applying a solution or an emulsion made from the same material to the surface of the reinforcing piece.

FIG. 2 shows a reinforcing portion 10 according to the present invention which is formed on only one side of the tape 3, while the other side of the tape is provided only with a reinforcing piece 14 and a bonding layer 15.

Figure 3:
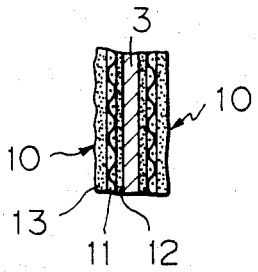
FIG. 3 is a section through another embodiment of the reinforcing portion according to the present invention, which is similar to FIG. 2.

However, as shown in FIG. 3, this tape-reinforcing portion need not necessarily be formed on only one side of the tape, it can also be formed on both sides. It must also be noted that the reinforcing portion 9 is formed in the same manner as the reinforcing portion 10. The reinforcing piece may be formed of taffeta. It is also possible to form a film of a plurality of thermoplastic synthetic resins having different melting points.

As shown in FIG. 2, it is preferable that the surface layer is finished so as to display an irregular form rather than a flat one. In addition, the layer 13 may, as shown in FIGS. 5A to 5E, be adapted to have a plurality of small recesses (FIG. 5A), crosswise protrusions (FIG. 5B), lengthwise protrusions (FIG. 5C), oblique protrusions (FIG. 5D), or small projections (FIG. 5E), so as to positively enable the non-slip manipulation of the slide fastener. These protrusion and small projections may be integrally formed on the surface layer.

Figure 4:
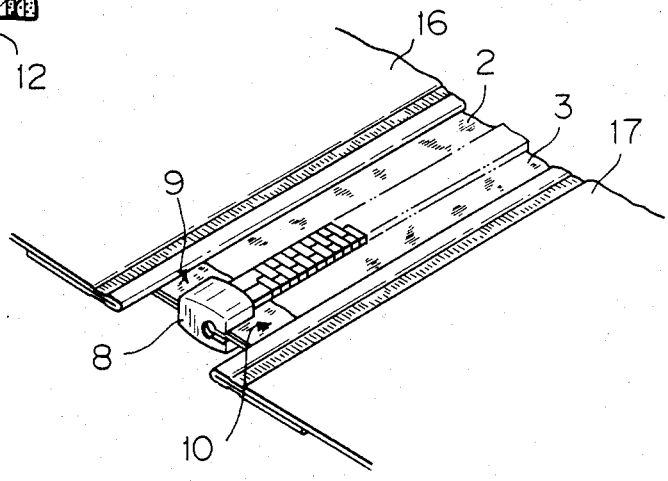
FIG. 4 is a perspective view of the slide fastener according to the present invention in a state in which the slide fastener is secured to the article.
Figure 5A:
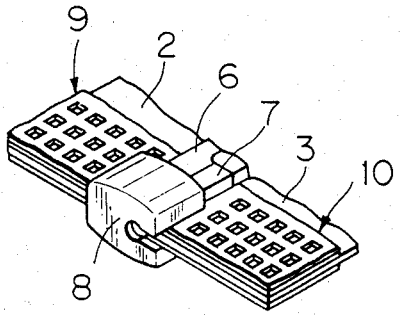
FIGS. 5A to 5E are perspective views of various embodiments of the reinforcing portion according to the present invention, which show the surface layers of the reinforcing portion provided with irregularities.
Figure 5B:
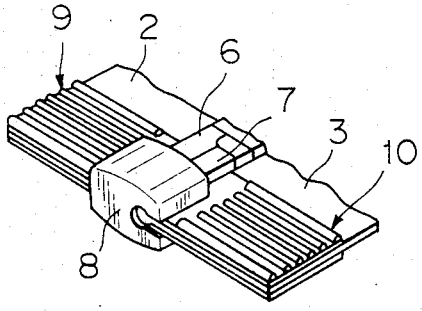
Figure 5C:
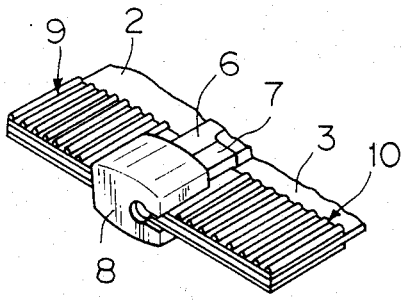
Figure 5D:
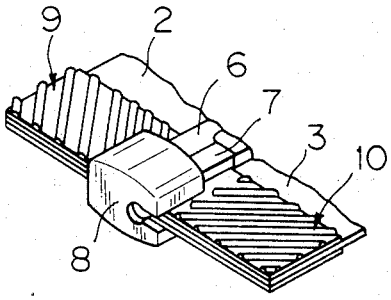
Figure 5E:
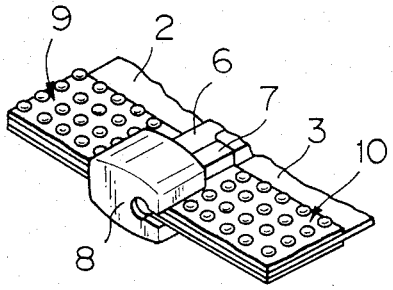

When the slide fastener 1 with a separable end stop according to the above-described embodiment is attached to portions 16, 17 of an article made from a sheet of a thermoplastic synthetic resin, such as polyvinyl chloride, each of side edge portions of the article is, as shown in FIG. 4, folded to provide a folded portion which is overlapped along the total length of the fastener tape, including the reinforcing portion 9 or 10, so that the folded portion of the article and the fastener tape can be welded together by an ultrasonic or high-frequency welding means.

It should be noted that, although the separable end stop in the embodiment shown in the figures is employed to separate and fit over the lower end portion of the slide fastener, a slide fastener of a so-called reverse-opening type, in which the fastener chains can be separated from the lower end portion of the fastener, may also be provided by employing the slider (not shown) instead of the box pin 8 for engaging or separating the fastener elements.

Since the slide fastener with a separable end stop according to the present invention has tape-reinforcing portions for mounting the separable end stop, which each include a reinforcing piece and a surface layer made of a thermoplastic resin and which are provided on the upper side of the reinforcing piece, it is possible to weld reinforcing portion to the article. At the same time, the reinforcing portions give an appropriate thickness and hardness to the corresponding edge portion of the fastener tape. Consequently, when each tape-reinforcing portion is held between the fingers through the portion of the article made of synthetic resin sheet to manipulate the separable end stop, the stiffness provided at the edge portions of the tapes ensures that the butterfly pin can be easily and accurately inserted into or separated from the box body.

What is claimed is:

1. A slide fastener comprising a pair of fastener tapes of a flexible thermoplastic resin material, a tape-reinforcing portion provided at one end portion of each of said pair of fastener tapes, and a separable end stop mounted on said tape-reinforcing portions, characterized in that each of said reinforcing portions comprises: a reinforcing piece made of a film of a synthetic resin having a high melting point and a surface layer on one side surface of said reinforcing piece, said surface layer being made of a film of a synthetic resin having a low melting point, the other side surface of said reinforcing piece being bonded to the associated fastener tape by a bonding layer of a low melting point.

2. A slide fastener according to claim 1 wherein each of said fastener tapes has said tape-reinforcing portion bonded to only one side of the tape.

* * * * *